US005655705A

United States Patent [19]

Bates

[11] Patent Number: 5,655,705

[45] Date of Patent: Aug. 12, 1997

[54] MULTI-PLY HANDLE FOR WRAP-AROUND CARTON

[75] Inventor: Aaron Bates, Marietta, Ga.

[73] Assignee: The Mead Corporation, Dayton, Ohio

[21] Appl. No.: 597,752

[22] Filed: Feb. 7, 1996

[51] Int. Cl.[6] ..... B65D 5/468

[52] U.S. Cl. ..... 229/117.16; 229/103.2

[58] Field of Search ..... 229/117.16, 103.2

[56] References Cited

U.S. PATENT DOCUMENTS

| | | | |
|---|---|---|---|
| 3,660,116 | 5/1972 | Clark | 229/117.16 |
| 3,797,731 | 3/1974 | Weldon | 229/117.16 |
| 4,101,048 | 7/1978 | Rieben et al. | 229/117.16 |
| 4,236,664 | 12/1980 | Hartelmuller | 229/117.16 |
| 4,319,710 | 3/1982 | Osborne | 229/117.16 |
| 5,072,876 | 12/1991 | Wilson | 229/103.2 |

FOREIGN PATENT DOCUMENTS

| | | | |
|---|---|---|---|
| 2556319 | 6/1985 | France | 229/117.16 |
| 1389711 | 4/1975 | United Kingdom | 229/117.16 |

*Primary Examiner*—Gary E. Elkins
*Attorney, Agent, or Firm*—Michael V. Drew

[57] ABSTRACT

A partially open wrap-around type carrier is combinable with a tray portion to form a composite carrier. The wrap-around carrier has a central panel flanked by opposing end panels and opposing side panels. One end panel is an end handle panel having hand-hole apertures for forming a handle. Connecting web/gussets respectively connect the end and side panels. One of the connecting webs/gussets includes a web/gusset handle panel wherein the web/gusset handle panel may be folded over into face contacting relationship with the end handle panel to form a multi-ply handle. The hand holes in the end handle panel and in the web/gusset handle panel may be configured to provide handles of different configurations.

14 Claims, 3 Drawing Sheets

MULTI-PLY HANDLE FOR WRAP-AROUND CARTON

BACKGROUND OF THE INVENTION

The invention relates generally to cartons, and more particularly to a multi-ply handle for a wrap-around type carrier wherein the additional carrier material used to form the multi-ply handle is derived from a modified corner web/gusset of the carrier.

Reinforced handles in cartons are useful to enable greater loads to be transported. A multi-ply handle is a useful means for providing a reinforced handle. A multi-ply handle requires at least one additional layer of carrier material in the region of the handle. A primary consideration in carrier production is to create a multi-ply handle without significantly increasing the amount of material used to produce the carrier.

SUMMARY OF THE INVENTION

In a preferred embodiment of the invention a partially open wrap-around type carrier is combinable with a tray portion to form a composite carrier. The wrap-around carrier has a reinforced handle which utilizes additional ply from a modified web/gusset of the carrier. The wrap-around carrier has a central panel flanked by opposing end panels and opposing side panels. One end panel is an end handle panel having hand-hole apertures for forming a handle. Connecting webs/gussets respectively connect the end and side panels. One of the connecting webs/gussets includes a web/gusset handle panel wherein the web/gusset handle panel may be folded over into face contacting relationship with the end handle panel to form a multi-ply handle. The hand holes in the end handle panel and in the web/gusset handle panel may be configured to provide handles of different configurations. For example, a slot type handle or a strip type handle may be formed.

Other advantages and objects of the present invention will be apparent from the following description, the accompanying drawings, and the appended claims.

DETAILED DESCRIPTION OF THE PREFERRED EMBODIMENT

Figure 1:
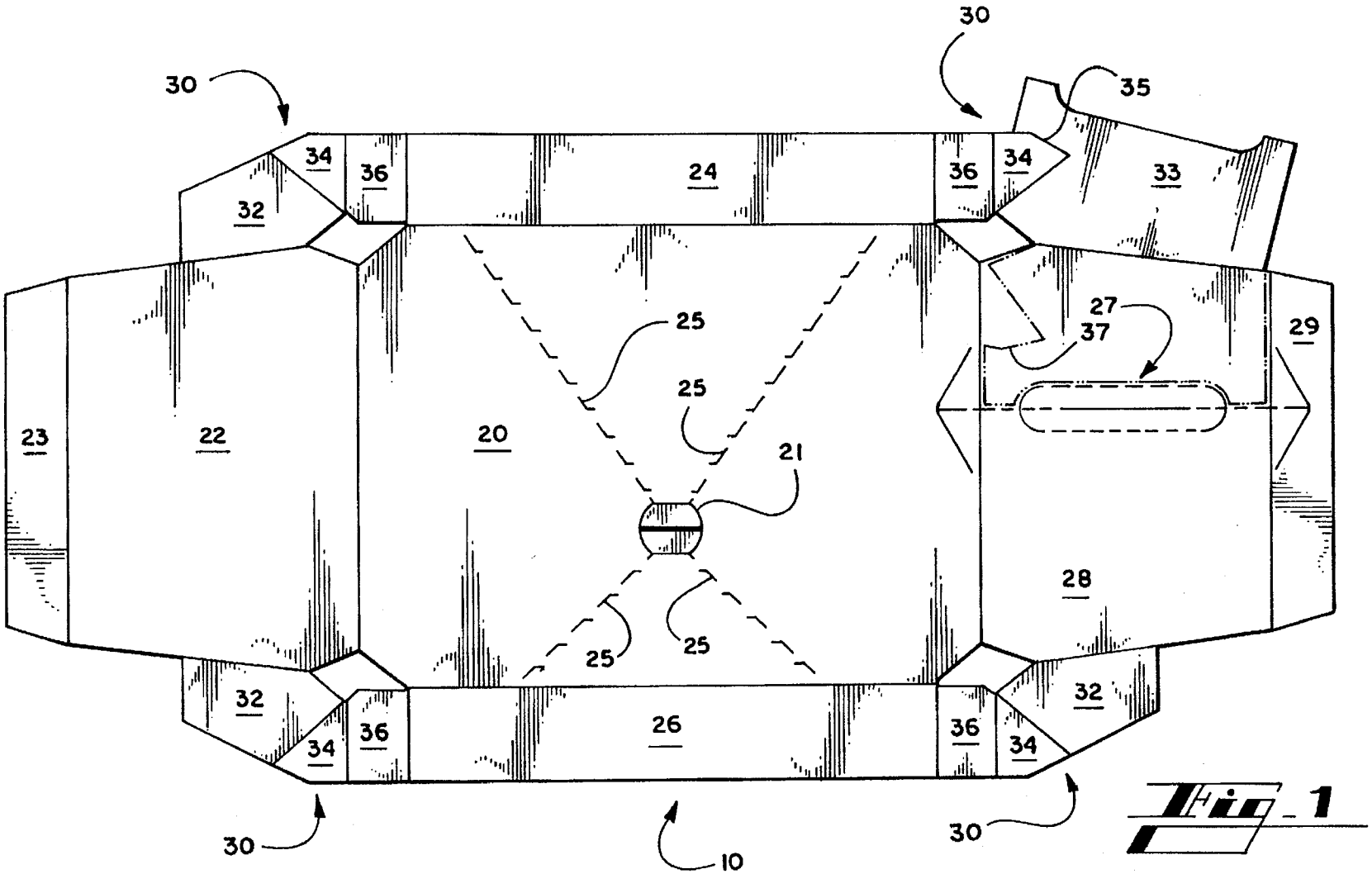
FIG. 1 is a top plan view of a blank for a wrap-around type carrier incorporating a multi-ply handle according to a preferred embodiment of the present invention.

The features of the invention will be explained in greater detail through the following description of a preferred embodiment of the invention. In the various views of the figures used and referred to to illustrate the preferred embodiment of the invention the same reference numerals are used to refer to like features.

Referring first to FIG. 1, therein is illustrated a blank 10 for a multi-ply handle for wrap-around type cartons according to a preferred embodiment of the invention. The blank 10 forms a partially-open wrap-around type carrier which together with a tray-like unit forms a composite carrier. In the blank 10 a central panel 20 is flanked by opposing side panels 24, 26 and opposing end panels 22, 28. The side panels 24, 26 are also referred to as "ad panels" because of their ability to prominently display advertising indicia in a completed package. Each end panel has a securement flap for attachment of the carrier to a tray portion. A hand hole 27 facilitates use of one of the end panels 28 as a handle panel. In this preferred embodiment the single hand hole slot 27 facilitates the use of a so-called "slot" handle. Webs/gussets 30 respectively formed at the corners of the carrier blank 10 foldably join side panels 24, 26 and end panels 22, 28 at their ends. The web/gusset panels 30 help facilitate formation of the blank 10 into a partially-open carrier having side and end walls which are normal to the central panel 20. Although any web/gusset pattern which facilitates formation of the blank 10 into a carton would be suitable, the preferred embodiment illustrated uses a three-panel web/gusset structure 32, 34, 36. The handle for the carrier is reinforced through means of a panel 33 which is placed in face contacting relationship with the end handle panel 28 thereby producing a multi-ply handle. The reinforcement panel 33 forms a part of the web/gusset structure which is the connecting web/gusset 30 for one of the corners where the end handle panel 28 and a side panel 24 terminate. The reinforcement panel 33 replaces the web/gusset panel that foldably adjoins the handle panel. The site of joinder of the reinforcement panel 33 with the remainder of the web/gusset structure 30 contains appropriately placed cut lines 35 that permit proper folding of the reinforcement panel 33 with respect to the remaining panels 34, 36 in the web/gusset structure 30. The manner in which the reinforcement panel 33 is superposed upon the handle panel 28 when folded thereunder is phantomly illustrated by the broken line 37.

Figure 2:
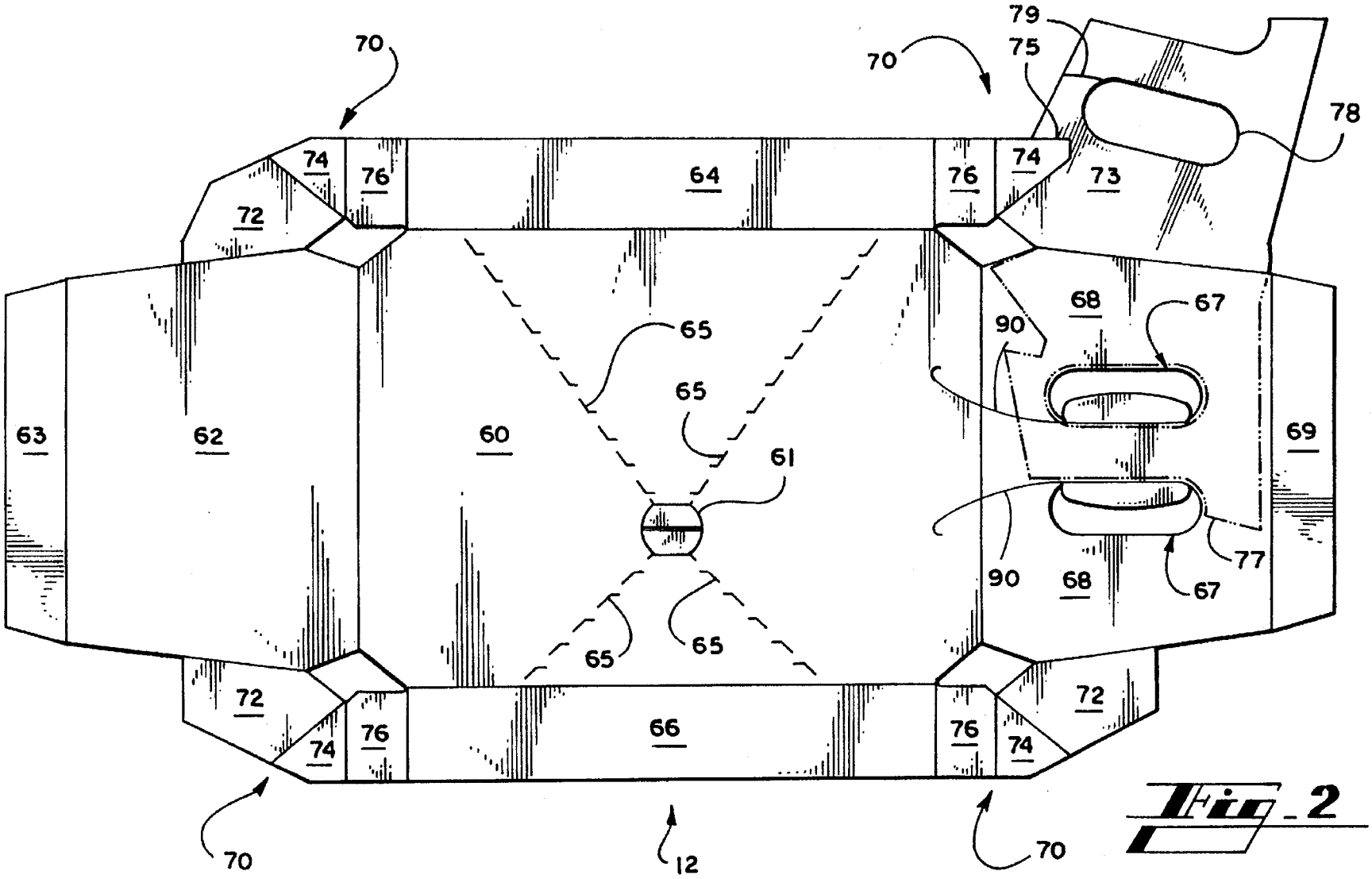
FIG. 2 is a top a plan view an alternative version of the carrier and multi-ply handle of FIG. 1.

Referring now to FIG. 2, therein is illustrated an alternative version of a blank 12 for forming a multi-ply handle for wrap-around type cartons according to a preferred embodiment of the invention. The alternative embodiment contains the same features as the embodiment of FIG. 1. For convenience of explanation, the features numbered utilizing the "20" and "30" series of reference numerals in FIG. 1 are similarly numbered in "60" and "70" series, respectively, in FIG. 2. The blank 12 (and carrier) of FIG. 2 differs from that of FIG. 1 in the style of handle used therein, namely, a strip type handle rather than the slot handle of FIG. 1. The strip handle is formed in the handle panel 68 between a pair of hand holes 67. The reinforcement panel 73 contains a handle hole 78 which is coaxially aligned with one of the hand holes 67 of the handle panel 68 when the panels 68, 73 are superposed upon one another. Likewise, the stress cut line 79 in the reinforcement panel is placed in superposed alignment with one of the stress cut lines 90 in the end 68 and central 60 panels when the panels 68, 73 are placed in face-contacting superposed relationship.

In the blank 10 of FIG. 1, a tear flap 21 and tear lines 25 are depicted to illustrate a manner in which a carrier formed from the blank 10 may be easily opened. However, the location of the tear flaps and lines is meant to be illustrative only. Tear flaps and or lines may be located in other suitable positions, such as along the edge of a securement flap 23, 29. In addition, other known means of gaining access to the interior of a carrier of articles may be employed. The tear-open feature is similarly illustrated in the blank of FIG. 2.

Figure 3:
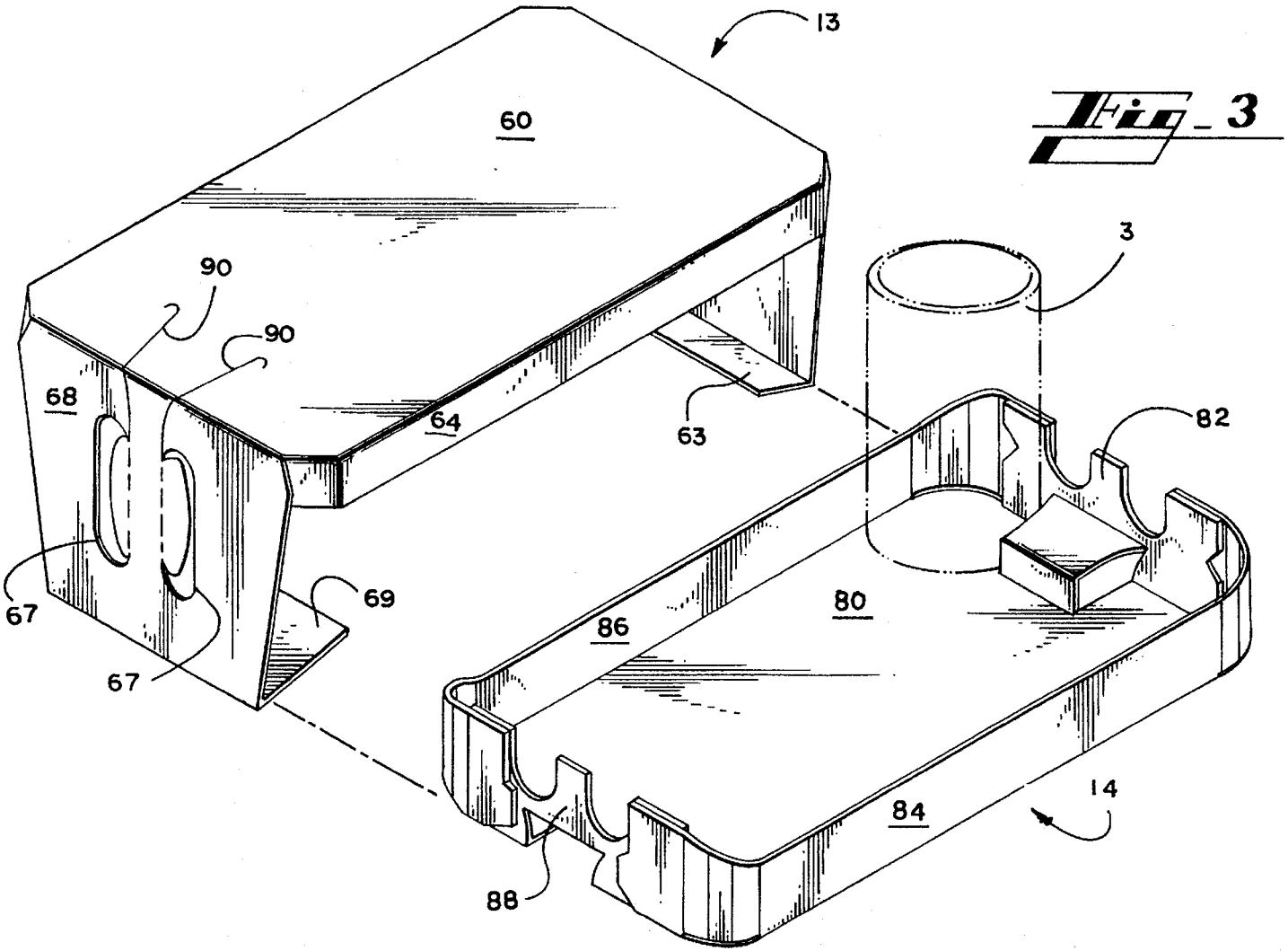
FIG. 3 is an isometric illustration of the multi-ply handle for wrap-around cartons as shown in FIG. 2, illustrated in conjunction with a tray with which a composite carrier is formed.

Referring now to FIG. 3, therein is illustrated the blank 12 of FIG. 2 erected to form a carrier 13 and a typical tray 14 with which the carrier 13 is suitable for use. The tray 14 may have any configuration which is compatible for use with the carrier of the invention. The tray illustrated has a central panel 80 which opposes the central panel 20, 60 of the invention. Upright side panels 84, 86 and end panels 82, 88 help form an effective means for retaining the bottoms of articles, such as cans 3, in an array. As illustrated, the tray 14 and partially-open carrier 13 formed from the blanks 10, 12 of the invention, combine to create a composite carrier which is enclosed at the top, bottom and ends but which is partially open at the sides. The reinforced handle by which the composite carrier may be lifted is formed in an end of the wrap-around carrier 13.

By means of the invention a handle reinforcing panel is created by modification of one of the corner webs/gussets which is used to erect the carton. In this manner additional carrier material which is needed to provide paneling for the multi-ply handle is minimized. It is to be noted that in the preferred embodiment illustrated a reinforcing panel utilizing minimal additional carrier material is effectively formed in a carrier in which the amount of material used in the overall carrier is minimized because of the carton's partially-open design. The strength of the handle of the carrier is increased with a minimal increase in carrier material.

Other modifications may be made in the foregoing without departing from the scope and spirit of the claimed invention.

What is claimed is:

1. A carrier comprising:

a central panel;

opposing side panels foldably adjoining said central panel;

opposing end panels foldably adjoining said central panel, at least one of said opposing end panels having at least one first hand-hole aperture defining a handle structure therein; and corner-forming joinder for said opposing side panels and said opposing end panels including at least one gusset structure foldably joining an end of one of said opposing side panels to a side of one of said opposing end panels, at least one of said at least one gusset structure including a gusset handle panel foldably adjoining said end panel which has said at least one first hand-hole aperture, said gusset handle panel having a configuration including a cut-out portion corresponding to at least a portion of said first hand-hole aperture, and wherein said gusset handle panel lies in flat-face relation with said end panel which has at least one first hand-hole aperture, and wherein said cut-out portion is superposed over said at least one first hand-hole aperture.

2. The carrier of claim 1, wherein said at least one first hand-hole aperture comprises a pair of spaced apart elongated apertures and said at least one cut-out portion includes a second hand-hole aperture.

3. The carrier of claim 1, wherein said gusset structure is tripartite and wherein said gusset handle panel comprises a segment of said tripartite gusset structure foldably adjoining a side of said end panel which has said at least one first hand-hole aperture.

4. The carrier of claim 1, further comprising a tray attached to said opposing end panels.

5. A carrier comprising:

a central panel;

opposing side panels foldably adjoining said central panel;

opposing end panels foldably adjoining said central panel, at least one of said opposing end panels having at least one first hand-hole aperture defining a handle structure therein; and corner-forming joinder for said opposing side panels and said opposing end panels including at least one gusset structure foldably joining an end of one of said opposing side panels to a side of one of said opposing end panels, at least one of said at least one gusset structure including a gusset handle panel foldably adjoining said end panel which has said at least one first hand-hole aperture, said gusset handle panel having a second hand-hole aperture, and wherein said gusset handle panel is in flat-face relation with said end panel which has at least one first hand-hole aperture, and wherein said second hand-hole aperture and one of at least one first hand-hole apertures are superposed over one another.

6. The carrier of claim 5, wherein said at least one first hand-hole aperture comprises a pair of spaced apart elongated apertures.

7. The carrier of claim 5, wherein said gusset structure is tripartite and wherein said gusset handle panel comprises a segment of said tripartite gusset structure foldably adjoining a side of said end panel which has said at least one first hand-hole aperture.

8. The carrier of claim 5, further comprising a tray attached to said opposing end panels.

9. A blank for forming a carrier comprising:

a central panel;

opposing side panels foldably adjoining said central panel;

opposing end panels foldably adjoining said central panel, at least one of said opposing end panels having at least one first hand-hole aperture defining a handle structure therein; and corner-forming joinder for said opposing side panels and said opposing end panels including at least one gusset structure foldably joining an end of one of said opposing side panels to a side of one of said opposing end panels, at least one of said at least one gusset structure including a gusset handle panel foldably adjoining said end panel which has said at least one first hand-hole aperture, said gusset handle panel having a configuration including a cut-out portion corresponding to at least a portion of said first hand-hole aperture such that when said carrier is erected from said blank said gusset handle panel may be folded into flat-face relation with said end panel which has at least one first hand-hole aperture wherein said cut-out portion is superposed over said at least one first hand-hole aperture.

10. The blank of claim 9, wherein said at least one first hand-hole aperture comprises a pair of spaced apart elongated apertures and said at least one cut-out portion includes a second hand-hole aperture.

11. The blank of claim 9, wherein said gusset structure is tripartite and wherein said gusset handle panel comprises a segment of said tripartite gusset structure foldably adjoining a side of said end panel which has said at least one first hand-hole aperture.

12. A blank for forming a carrier comprising:

a central panel;

opposing side panels foldably adjoining said central panel;

opposing end panels foldably adjoining said central panel, at least one of said opposing end panels having at least one first hand-hole aperture defining a handle structure therein; and corner-forming joinder for said opposing side panels and said opposing end panels including at least one gusset structure foldably joining an end of one of said opposing side panels to a side of one of said opposing end panels, at least one of said at least one gusset structure including a gusset handle panel foldably adjoining said end panel which has said at least one first hand-hole aperture, said gusset handle panel having a second hand-hole aperture such that when the blank is erected to form the carrier said gusset handle panel may be folded into flat-face relation with said end panel which has at least one first hand-hole aperture wherein said second hand-hole aperture and one of said at least one first hand-hole apertures are superposed over one another.

13. The blank of claim 12, wherein said at least one first hand-hole aperture comprises a pair of spaced apart elongated apertures.

14. The blank of claim 12, wherein said gusset structure is tripartite and wherein said gusset handle panel comprises a segment of said tripartite gusset structure foldably adjoining a side of said end panel which has said at least one first hand-hole aperture.

* * * * *